US010876448B2

(12) United States Patent
Doi

(10) Patent No.: US 10,876,448 B2
(45) Date of Patent: Dec. 29, 2020

(54) OIL MIST SEPARATOR

(71) Applicant: TOYOTA BOSHOKU KABUSHIKI KAISHA, Aichi (JP)

(72) Inventor: Kensuke Doi, Obu (JP)

(73) Assignee: TOYOTA BOSHOKU KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/540,428

(22) Filed: Aug. 14, 2019

(65) Prior Publication Data

US 2020/0063619 A1 Feb. 27, 2020

(30) Foreign Application Priority Data

Aug. 22, 2018 (JP) ..... 2018-155460

(51) Int. Cl.
*F01M 13/04* (2006.01)

(52) U.S. Cl.
CPC ..... *F01M 13/04* (2013.01); *F01M 2013/0438* (2013.01); *F01M 2013/0461* (2013.01); *F01M 2013/0466* (2013.01)

(58) Field of Classification Search
CPC ..... F01M 13/04; F01M 2013/0438; F01M 2013/0422; F01M 2013/0433
See application file for complete search history.

(56) References Cited

U.S. PATENT DOCUMENTS 5,992,397 A * 11/1999 Hideaki ..... F02M 25/0854 123/538
2016/0097352 A1* 4/2016 Takeuchi ..... F02M 35/0217 96/74
2016/0160716 A1* 6/2016 Horiuchi ..... B01D 46/0032 96/65
2017/0021365 A1* 1/2017 Takeuchi ..... B03C 3/366
2017/0081998 A1* 3/2017 Morishita ..... F01M 13/04
2019/0195098 A1* 6/2019 Sazawa ..... B03C 3/366

FOREIGN PATENT DOCUMENTS

JP 2017-57805 3/2017

* cited by examiner

*Primary Examiner* — Long T Tran
(74) *Attorney, Agent, or Firm* — Greenblum & Bernstein, P.L.C.

(57) ABSTRACT

An oil mist separator includes a case, an oil collecting portion, and a gradual change portion. The case includes a case main body, an inlet for blow-by gas provided on an upstream side of the case main body in a flowing direction of the blow-by gas, and an outlet for blow-by gas provided on a downstream side in the flowing direction of the case main body. The oil collecting portion is accommodated in the case main body. The gradual change portion is provided in the case and is located in at least one of a space between the inlet and the oil collecting portion in the flowing direction and a space between the oil collecting portion and the outlet in the flowing direction. A cross-sectional flow area of the gradual change portion is gradually decreased as a distance from the oil collecting portion in the flowing direction increases.

10 Claims, 3 Drawing Sheets

OIL MIST SEPARATOR

BACKGROUND

1. Field

The present disclosure relates to an oil mist separator.

2. Description of Related Art

Internal combustion engines are equipped with a recirculation passage for recirculating blow-by gas in the crank chamber to the intake passage. An oil mist separator is provided in such a recirculation passage to separate oil mist from blow-by gas (for example, Japanese Laid-Open Patent Publication No. 2017-57805).

The oil mist separator disclosed in the publication includes a case that has a rectangular parallelepiped case main body, a tubular inlet into which blow-by gas flows, and a tubular outlet from which blow-by gas flows out. The inlet protrudes from a side wall that constitutes one end of the case main body. The outlet protrudes from a side wall that constitutes the other end of the case main body. The oil mist separator also includes electrode plates accommodated in the case main body and filters made of an electrically insulating material. The electrode plates are arranged to be opposed to each other with a space in between. Each filter is arranged between adjacent two of the electrode plates.

The case main body of the above-described publication has a rectangular parallelepiped shape, and the cross-sectional area of the case main body in the direction of flow of blow-by gas from the inlet to the outlet is larger than the cross-sectional areas of the inlet and the outlet. Thus, the cross-sectional flow area abruptly changes at the joint between the inlet and the case main body and at the joint between the case main body and the outlet. This is likely to generate swirls and may increase the pressure loss.

SUMMARY

Accordingly, it is an objective of the present disclosure to provide an oil mist separator that reduces pressure loss.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, an oil mist separator is provided that is configured to be arranged in a recirculation passage that recirculates blow-by gas of an internal combustion engine to an intake passage and to separate oil mist from the blow-by gas. The oil mist separator includes a case, an oil collecting portion, and a gradual change portion. The case includes a case main body, an inlet for blow-by gas provided on an upstream side of the case main body in a flowing direction of the blow-by gas, and an outlet for blow-by gas provided on a downstream side in the flowing direction of the case main body. The oil collecting portion is accommodated in the case main body and includes electrode plates that are arranged to be opposed to each other with a space in between and filters each of which is arranged between the adjacent electrode plates. The gradual change portion is provided in the case and is located in at least one of a space between the inlet and the oil collecting portion in the flowing direction and a space between the oil collecting portion and the outlet in the flowing direction. A cross-sectional flow area of the gradual change portion is gradually decreased as a distance from the oil collecting portion in the flowing direction increases.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An oil mist separator according to an embodiment will now be described with reference to FIGS. 1 to 3.

The oil mist separator of the present embodiment is arranged in a recirculation passage, which recirculates blow-by gas in the crank chamber of an internal combustion engine to the intake passage.

Figure 1:
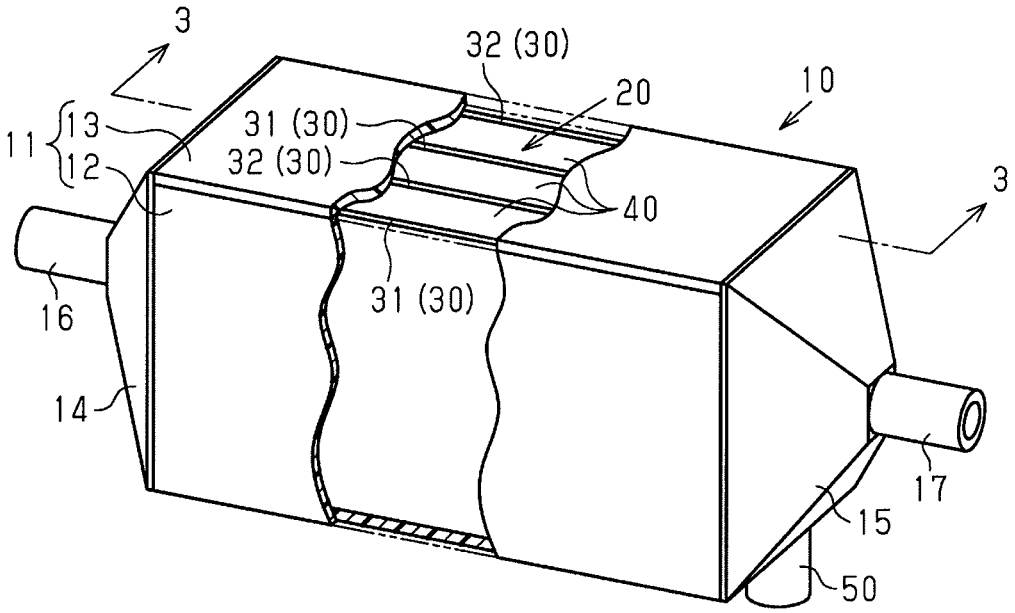
FIG. 1 is a perspective view illustrating the structure of an oil mist separator according to an embodiment.

As shown in FIG. 1, the oil mist separator includes a case 10 that has a case main body 11, a blow-by gas inlet 16, and a blow-by gas outlet 17. The case main body 11 has a rectangular parallelepiped shape. The inlet 16 is provided at one end in the longitudinal direction (lateral direction in FIG. 1) of the case main body 11. The outlet 17 is provided at the other end in the longitudinal direction of the case main body 11. The inlet 16 and the outlet 17 are both cylindrical.

The case main body 11 includes a tub member 12 and a lid member 13. The tub member 12 has a shape of a tub with an open upper part, and the lid member 13 covers the upper part of the tub member 12. The tub member 12 and the lid member 13 are both made of insulating plastic material.

Blow-by gas in the crank chamber of the internal combustion engine flows into the case main body 11 through the inlet 16 and flows out to the outside through the outlet 17. Hereinafter, the direction of flow of blow-by gas from the inlet 16 to the outlet 17 will simply be referred to as flowing direction. In the flowing direction, the side at which the inlet 16 is provided will be referred to as an upstream side, and the side at which the outlet 17 is provided will be referred to as a downstream side. In the present embodiment, since the inlet 16 and the outlet 17 are provided at one end and the other end in the longitudinal direction of the case main body 11, the longitudinal direction corresponds to the flowing direction.

Figure 2:
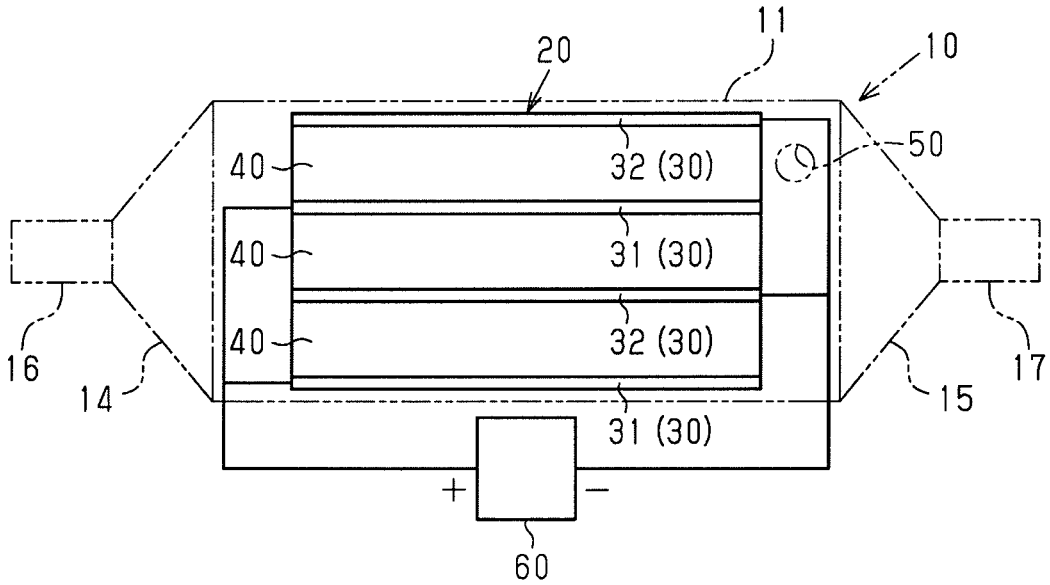
FIG. 2 is a schematic diagram showing the electrical relationship of the voltage generator of the embodiment with positive plates and negative plates.
Figure 3:
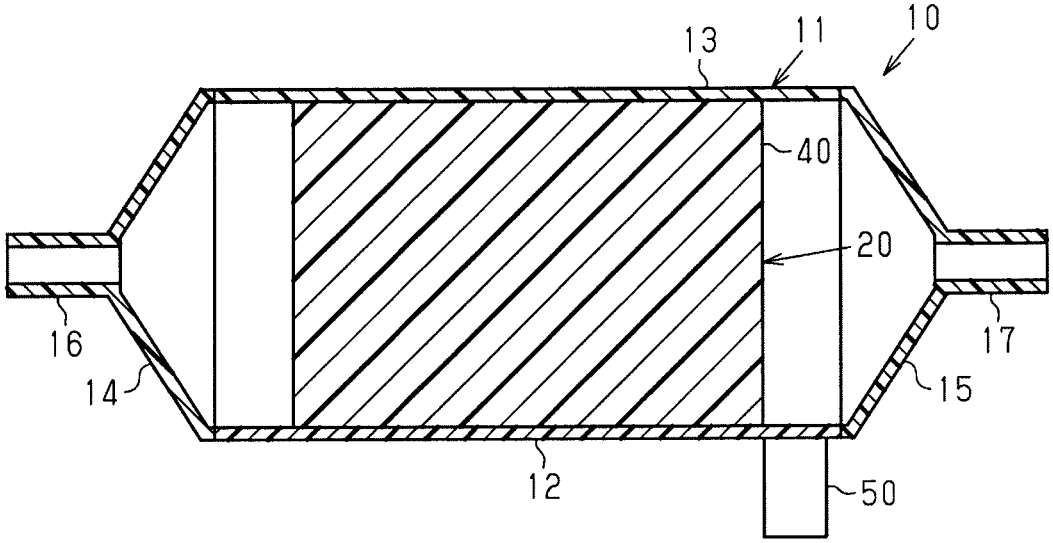
FIG. 3 is a cross-sectional view taken along line 3-3 of FIG. 1.

As shown in FIGS. 1 to 3, the case 10 has an upstream-side gradual change portion 14 located in a space between the upstream end of the case main body 11 and the inlet 16 in the flowing direction. The cross-sectional flow area of the upstream-side gradual change portion 14 is gradually decreased toward the upstream end. The upstream-side gradual change portion 14 is made of insulating plastic material and has a rectangular frustum shape.

As shown in FIG. 3, the inner surface of the upstream-side gradual change portion 14 and the inner surface of the case main body 11 are continuous without any steps. That is, in the flowing direction, the cross-sectional shape of the flow passage at the downstream end of the upstream-side gradual change portion 14 is the same as the cross-sectional shape of the flow passage at the upstream end of the case main body 11.

As shown in FIGS. 1 to 3, the case 10 also has a downstream-side gradual change portion 15 located in a space between the downstream end in the flowing direction of the case main body 11 and the outlet 17. The cross-sectional flow area of the downstream-side gradual change portion 15 is gradually decreased toward the downstream end. The downstream-side gradual change portion 15 is made of insulating plastic material and has a rectangular frustum shape.

As shown in FIG. 3, the inner surface of the downstream-side gradual change portion 15 and the inner surface of the case main body 11 are continuous without any steps. That is, in the flowing direction, the cross-sectional shape of the flow passage at the upstream end of the downstream-side gradual change portion 15 is the same as the cross-sectional shape of the flow passage at the downstream end of the case main body 11.

As shown in FIGS. 1 to 3, the case main body 11 incorporates an oil collecting portion 20. The oil collecting portion 20 includes multiple electrode plates 30 and filters 40. The electrode plates 30 are arranged to be opposed to each other with a space in between. In the present embodiment, four electrode plates 30 are provided. Each filter 40 is made of an electrically insulating material and arranged between adjacent electrode plates 30.

Each electrode plate 30 is either a rectangular positive plate 31 or a rectangular negative plate 32, which is made of stainless steel, for example. The positive plates 31 and the negative plates 32 are arranged in the case main body 11 and separated from the upstream end and the downstream end of the case main body 11. The positive plates 31 and the negative plates 32 are alternately arranged with a space in between in the width direction (vertical direction in FIG. 2) of the case main body 11. The positive plates 31 and the negative plates 32 have the same shape.

As shown in FIG. 2, a voltage generator 60 is electrically connected to the positive plates 31 and the negative plates 32. More specifically, the positive electrode (+) of the voltage generator 60 is connected to the positive plates 31, and the negative electrode (−) of the voltage generator 60 is connected to the negative plates 32. This creates a potential difference between each positive plate 31 and the adjacent negative plate 32.

Each filter 40 is made of fibers of insulating materials in which dielectric polarization occurs, such as polyester. Each filter 40 is held between the positive plate 31 and the negative plate 32. The dimensions of the filters 40 in the flowing direction and the vertical direction are the same as those of the positive plates 31 and the negative plates 32.

As shown in FIGS. 1 to 3, a tubular oil drain port 50 projects downward from a part of the bottom of the tub member 12 (the part opposed to the lid member 13) that is located between the oil collecting portion 20 and the downstream-side gradual change portion 15.

The operation of the present embodiment will now be described.

Blow-by gas in the crank chamber of the internal combustion engine flows into the case main body 11 through the inlet 16 and flows out from the outlet 17. At this time, since voltage is applied to the positive plates 31 and the negative plates 32 by the voltage generator 60, dielectric polarization occurs in the filters 40. Thus, electrically charged portion of the oil mist contained in the blow-by gas flowing through the filters 40 is readily adsorbed by the filters 40 due to the electrostatic force. Accordingly, oil mist is separated from the blow-by gas. The oil mist separated from the blow-by gas drops down under its own weight. Then the pressure of the blow-by gas moves the oil to the downstream side along the bottom of the case main body 11 (the tub member 12) and is then drained to the outside through the oil drain port 50.

The upstream-side gradual change portion 14 is provided in a space between the inlet 16 and the upstream end of the case main body 11, and the downstream-side gradual change portion 15 is provided in a space between the downstream end of the case main body 11 and the outlet 17. Thus, when the blow-by gas flows into or out of the case main body 11, the cross-sectional flow area in the flowing direction does not change abruptly (Operation 1).

Also, the blow-by gas that flows in through the inlet 16 flows along the inner wall of the upstream-side gradual change portion 14. This allows the blow-by gas flowing into the case main body 11 to readily reach wider range at the upstream end of the oil collecting portion 20. Accordingly, most of the oil mist contained in the blow-by gas is separated from the blow-by gas in the upstream sections of the filters 40 (Operation 2).

The upstream-side gradual change portion 14 and the downstream-side gradual change portion 15 have a rectangular frustum shape and are connected to the rectangular parallelepiped case main body 11 without any steps. That is, the inner surface of the upstream-side gradual change portion 14 and the inner surface of the downstream-side gradual change portion 15 are smoothly continuous with the inner surface of the case main body 11. Therefore, the pressure loss is unlikely to occur between the upstream-side gradual change portion 14 and the case main body 11 and between the downstream-side gradual change portion 15 and the case main body 11 (Operation 3).

The present embodiment has the following advantages.

(1) The case 10 has the upstream-side gradual change portion 14, which is located in a space between the upstream end of the case main body 11 and the inlet 16 in the flowing direction. The cross-sectional flow area of the upstream-side gradual change portion 14 is gradually decreased toward the upstream end. The case 10 also has the downstream-side gradual change portion 15, which is located in a space between the downstream end of the case main body 11 and the outlet 17 in the flowing direction. The cross-sectional flow area of the downstream-side gradual change portion 15 is gradually decreased toward the downstream end.

This configuration operates in the manner of Operation 1, thereby suppressing generation of swirls. This reduces the pressure loss of the blow-by gas.

This configuration operates in the manner of Operation 2, thereby reducing the pressure loss of the blow-by gas and improving the oil collecting performance of the oil mist separator.

(2) The case main body 11 has a rectangular parallelepiped shape, and the upstream-side gradual change portion 14 and the downstream-side gradual change portion 15 have rectangular frustum shapes. The inner surface of the upstream-side gradual change portion 14 and the inner surface of the downstream-side gradual change portion 15 are continuous with the inner surface of the case main body 11 without any steps.

This configuration achieves the operation 3 and thus further reduces the air pressure loss of the blow-by gas.

The above-described embodiment may be modified as follows. The above-described embodiment and the following modifications can be combined as long as the combined modifications remain technically consistent with each other.

The same reference numerals are given to those components in first and second modifications that are the same as those of the above-described embodiment. Components of the modifications that are equivalent to those in the-above-described embodiment are given reference numerals obtained by adding 100 or 200 to the reference numerals of the above-described embodiment, and redundant explanations are omitted.

Figure 4:
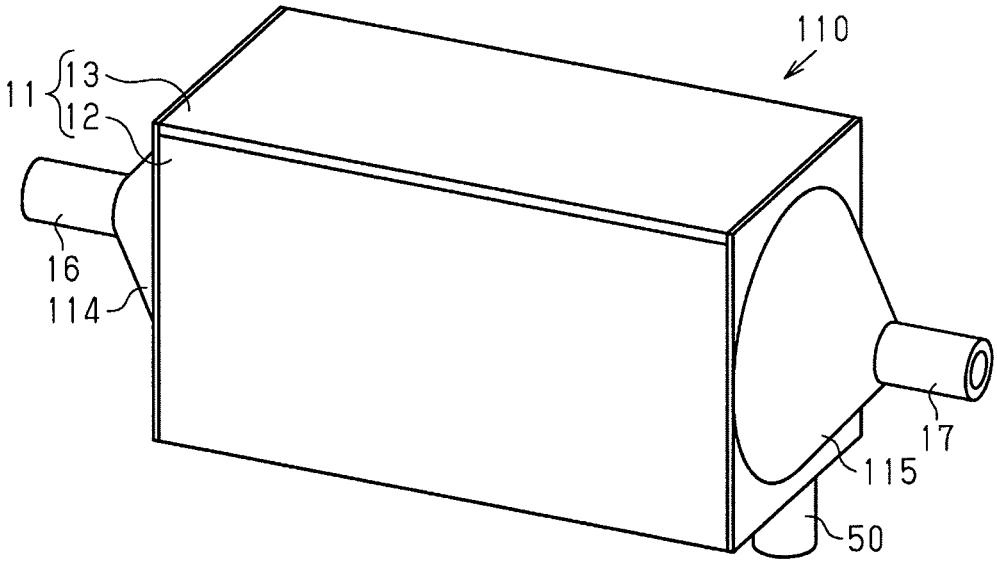
FIG. 4 is a perspective view of an oil mist separator according to a first modification.

The upstream-side gradual change portion 14 and the downstream-side gradual change portion 15 do not necessary need to have rectangular frustum shapes. For example, a case 110 shown in FIG. 4 may be employed. The case 110 has an upstream-side gradual change portion 114 and a downstream-side gradual change portion 115 each having a conical frustum shape. Further, these may have polygonal frustum shape such as a triangular frustum and a pentagonal frustum.

Figure 5:
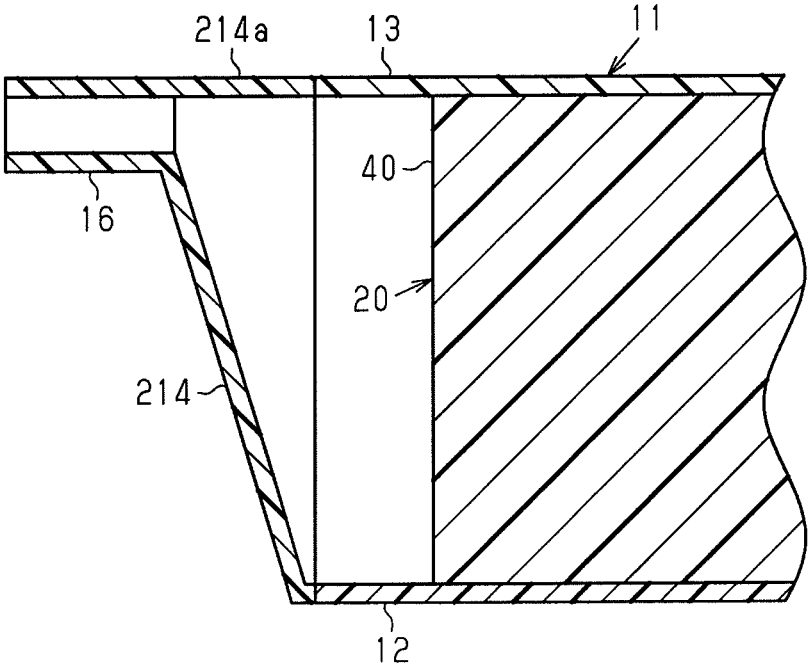
FIG. 5 is a cross-sectional view of an oil mist separator according to a second modification.

As shown in FIG. 5, an upstream-side gradual change portion 214 having a rectangular frustum shape may be used. The upstream-side gradual change portion 214 has a wall portion 214*a* that extends along the lid member 13 of the case main body 11.

The case main body 11 of the above-described embodiment has a rectangular parallelepiped shape, but may have a cylindrical shape. In this case, the cross-sectional shape of the oil collecting portion 20 is preferably circular in accordance with the cross-sectional shape of the case main body.

The upstream end and the downstream end of the case main body 11, at which the oil collecting portion 20 is not provided, may have a frustum shape in accordance with the upstream-side gradual change portion and the downstream-side gradual change portion.

The upstream-side gradual change portion 14 and the downstream-side gradual change portion 15 may be formed integrally with the case main body 11.

A shield that gradually changes the cross-sectional flow area of blow-by gas may be provided in the rectangular parallelepiped case main body to constitute an upstream-side gradual change portion or a downstream-side gradual change portion.

The downstream-side gradual change portion 15 may be omitted so that a case having only the upstream-side gradual change portion 14 is provided. Alternatively, the upstream-side gradual change portion 14 may be omitted so that a case having only the downstream-side gradual change portion 15 is provided.

The inlet 16 and the upstream-side gradual change portion 14 may be provided in one of the bottom of the tub member 12 and the lid member 13, and the outlet 17 and the downstream-side gradual change portion 15 may be provided in the other one of the bottom of the tub member 12 and the lid member 13. In this case, the longitudinal direction of the case main body 11 and the blow-by gas flowing direction are different from each other.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An oil mist separator configured to be arranged in a recirculation passage that recirculates blow-by gas of an internal combustion engine to an intake passage and to separate oil mist from the blow-by gas, the oil mist separator comprising:

a case that includes a case main body, an inlet for blow-by gas provided on an upstream side of the case main body in a flowing direction of the blow-by gas, and an outlet for blow-by gas provided on a downstream side in the flowing direction of the case main body;

an oil collecting portion that is accommodated in the case main body and includes electrode plates that are arranged to be opposed to each other with a space in between and filters each of which is arranged between the adjacent electrode plates; and a gradual change portion provided in the case, the gradual change portion being located in at least one of a space between the inlet and the oil collecting portion in the flowing direction and a space between the oil collecting portion and the outlet in the flowing direction, wherein a cross-sectional flow area of the gradual change portion is gradually decreased as a distance from the oil collecting portion in the flowing direction increases.

2. The oil mist separator according to claim 1, wherein the gradual change portion includes an upstream-side gradual change portion arranged in the case, the upstream-side gradual change portion being located between the inlet and the oil collecting portion.

3. The oil mist separator according to claim 2, wherein the case main body has a rectangular parallelepiped shape, the upstream-side gradual change portion has a frustum shape, and an inner surface of the upstream-side gradual change portion and an inner surface of the case main body are continuous without any steps.

4. The oil mist separator according to claim 2, wherein the gradual change portion includes a downstream-side gradual change portion arranged in the case, the downstream-side gradual change portion being located between the oil collecting portion and the outlet.

5. The oil mist separator according to claim 4, wherein the case main body has a rectangular parallelepiped shape, the downstream-side gradual change portion has a frustum shape, and an inner surface of the downstream-side gradual change portion and an inner surface of the case main body are continuous without any steps.

6. An oil mist separator configured to be arranged in a recirculation passage that recirculates blow-by gas of an internal combustion engine to an intake passage and to separate oil mist from the blow-by gas, the oil mist separator comprising:

a case that includes a case main body, an inlet for blow-by gas provided on an upstream side of the case main body in a flowing direction of the blow-by gas, and an outlet for blow-by gas provided on a downstream side in the flowing direction of the case main body;

an oil collector that is accommodated in the case main body and includes electrode plates that are arranged to be opposed to each other with a space in between and filters each of which is arranged between the adjacent electrode plates; and a gradual change conduit provided in the case, the gradual change conduit being located in at least one of a space between the inlet and the oil collector in the flowing direction and a space between the oil collector and the outlet in the flowing direction, and the gradual change conduit including a wall that is disposed obliquely relative to the flowing direction, wherein a cross-sectional flow area of the gradual change conduit is gradually decreased as a distance from the oil collector in the flowing direction increases.

7. The oil mist separator according to claim 6, wherein the gradual change conduit includes an upstream-side gradual change conduit arranged in the case, the upstream-side gradual change conduit being located between the inlet and the oil collector.

8. The oil mist separator according to claim 7, wherein the case main body has a rectangular parallelepiped shape, the upstream-side gradual change conduit has a frustum shape, and an inner surface of the upstream-side gradual change conduit and an inner surface of the case main body are continuous without any steps.

9. The oil mist separator according to claim 7, wherein the gradual change conduit includes a downstream-side gradual change conduit arranged in the case, the downstream-side gradual change conduit being located between the oil collector and the outlet.

10. The oil mist separator according to claim 9, wherein the case main body has a rectangular parallelepiped shape, the downstream-side gradual change conduit has a frustum shape, and an inner surface of the downstream-side gradual change conduit and an inner surface of the case main body are continuous without any steps.

* * * * *